US007706933B2

(12) United States Patent
Mally

(10) Patent No.: US 7,706,933 B2
(45) Date of Patent: Apr. 27, 2010

(54) METHOD AND SYSTEM OF AIDING THE MOVEMENT OF WORKS TRAINS

(75) Inventor: Alain Mally, Bazeilles (FR)

(73) Assignee: Societe Nationale des Chemins de fer Francais, Paris (FR)

( * ) Notice: Subject to any disclaimer, the term of this patent is extended or adjusted under 35 U.S.C. 154(b) by 788 days.

(21) Appl. No.: 10/572,018

(22) PCT Filed: Oct. 29, 2004

(86) PCT No.: PCT/FR2004/002787

§ 371 (c)(1),
(2), (4) Date: Dec. 29, 2006

(87) PCT Pub. No.: WO2005/042331

PCT Pub. Date: May 12, 2005

(65) Prior Publication Data

US 2007/0176054 A1 Aug. 2, 2007

(30) Foreign Application Priority Data

Oct. 29, 2003 (FR) ..... 03 12683

(51) Int. Cl.
*G05D 1/00* (2006.01)

(52) U.S. Cl. ..... 701/19; 701/301

(58) Field of Classification Search ..... 701/19, 701/36, 20, 300, 301, 23, 24; 104/26.1; 246/15
See application file for complete search history.

(56) References Cited

U.S. PATENT DOCUMENTS 7,546,185 B2 * 6/2009 Muinonen et al. ..... 701/19
7,558,740 B2 * 7/2009 Matheson et al. ..... 705/8
7,565,228 B2 * 7/2009 Muinonen et al. ..... 701/19

* cited by examiner

*Primary Examiner*—Richard M. Camby
(74) *Attorney, Agent, or Firm*—Novak Druce & Quigg; J. Rodman Steele, Jr.; Gregory M. Lefkowitz

(57) ABSTRACT

The present invention relates to a system for aiding the movement of work trains on a railway line under construction having two tracks that are adjacent and two-way, managed from a central block PC by a PC chief. The system comprises a computer with means of management and of processing of data and an operation block diagram panel, means of communication between the PC chief and escort agents of the work trains for authorization requests to move in section, means of locating a train, connected to the computer, means of detecting the direction of travel of a train, connected to the computer, and means of entering the state of work of the sectors, connected to the computer.

The system saves time by enabling a work train to move, under certain conditions, at the speed of the line.

15 Claims, 7 Drawing Sheets

METHOD AND SYSTEM OF AIDING THE MOVEMENT OF WORKS TRAINS

FIELD OF THE INVENTION

The invention primarily relates to a method of aiding the movement of work trains on a railway line under construction.

BACKGROUND

On a line in operation, a track is divided into sections of 400 to 2500 m, on each of which the trains move at a speed depending on a signal exhibited at the entrance to the section, usually the colour of a three-colour traffic light, which is green, if the section is free, orange, if the next section is occupied by a train—the light at the entrance of this next section is therefore red-, and red, if the preceding section is occupied.

For a train to be able to run on a section at the speed of the line, that is to say run "in section", it is preferred that at least the two sections that follow this section are free of any other train. It is in these conditions that the signal is green at the entrance of the section in question.

The presence of a train on a section is detected by a track circuit which controls the signalling elements that have just been evoked.

Fitting a line under construction with such a signalling system is out of the question. Its cost would be prohibitive.

Up to now, the signalling for the movement of work trains on the tracks of a railway line under construction has been provided in empirical fashion by the work-site personnel with the aid of signboards and other panels and of radio and telephone means. The major disadvantage of such an empirical solution, not to mention the requirement for significant staffing, is that it limits the speed of the trains on the tracks, the drivers being obliged to drive "in work mode", that is to say running by sight.

SUMMARY OF THE INVENTION

The applicant is therefore proposing here a new solution, but in the restricted context of a new line under construction

- with two adjacent tracks,
- each track being two-way, that is to say that the trains can move on it in both directions.

Thus, the present application concerns primarily a method of aiding the movement of work trains on a railway line under construction with two tracks that are adjacent and two-way, managed from a central block PC by a PC chief in which

- the tracks are divided into sectors Si extending between two end blocks (i and i+2) on which the trains can move in section or in work mode,
- at the request for authorization, to move in section in one direction on a given sector Si, from an escort agent of a train to the PC chief,
- a check is made as to whether another train is moving on the sector Si in question,
- a check is made as to whether another train is moving on the following sector $S_{i+2}$ in the opposite direction,
- a check is made as to whether the adjacent sector $S_{i+1}$ of the adjacent track is undergoing work and
- if the three checks are negative,
- the authorization is given by the PC chief to the escort agent to move his train in section.

The technical effect of the method of the invention resides in the ability, in certain conditions, to have a work train move at the speed of the line, much greater than the speed of movement when running by sight and to gain precious time. To give an idea, the invention can be used, on 10 to 15 km sectors, to achieve a speed of 80 km/h instead of 30 km/h in work, and to move at an average speed of 45-50 km/h when it is only 20-25 km/h with a running-by-sight movement.

Preferably, at each block delimiting a sector, extending over a certain length,

- a check is made as to whether no train is moving in the opposite direction on the block i+2 terminating the sector Si in question,
- to authorize movement in section on the sector Si in question.

Advantageously, a train leaving a set of formation sidings of a marshalling zone of a work base travels via a track junction block before moving on the line, an agent of the points-marshalling block, after agreement by the PC chief, controlling the predicted itinerary over the track junction block.

In this case, after actuating the points of the track junction block, the agent of the points-marshalling block delivers the authorization for the train to leave the set of formation sidings to move on the line.

Again preferably, a signal is given to the work train that it has reached a beginning or an end of block Pi and

- when it reaches a beginning of block Pi, the train moves until it is completely on the length of the block and the escort agent then makes a request to the PC chief to move in section on the following sector Si and
- when it reaches an end of block Pi, it complies with an injunction to wait or with an authorization to move on the sector Si.

The invention also relates to a system of aiding the movement of work trains on a railway line under construction with two tracks that are adjacent and two-way managed from a central block PC by a PC chief, the tracks being divided into sectors Si extending between two end blocks Pi (i and i+2) on which the trains can move in section or in work mode, the system comprising

- a computer at the central block comprising means of management and means of processing of data and a block diagram panel for operating the line under construction, with at least its tracks, its sectors and its end blocks,
- means of communication between the PC chief and escort agents of the work trains for authorization requests, to move in section in one direction on a given sector Si, from an escort agent of a train to the PC chief,
- means of storing messages (Mi),
- means of locating a train on the sectors of the line, connected to the computer,
- means of detecting the direction of travel of a train on the sectors of the line, connected to the computer,
- means of entering the state of work of the sectors, connected to the computer and
- processing means processing the data from the means of detection and of location so that, if
  - a) no other train is moving on a sector in question Si,
  - b) no other train is moving on the following sector Si+2 in the opposite direction,
  - c) the adjacent sector Si+1 of the sector Si of the adjacent track is not in work mode,
  - the PC chief authorizes the escort agent of a train to move in section on the sector Si in question from the end i to the end i+2.

Preferably, a sector Si is represented on the block diagram of the central block PC as totally occupied when a work train is moving on it.

Again preferably, the means of locating trains on the sectors comprise signalling elements of beginning and end of blocks Pi flanking the sectors Si and identifying the blocks and the sectors, means of communication between the train and the central block arranged so as to exchange messages (Mi), in particular requests (M1), injunctions to wait (M2) or authorizations (M3).

Again preferably, the signalling elements are indicator panels but may also be, according to a more elaborate form of embodiment, radio beacons.

In the first case, it is the escort agent who generates the transmission of the request messages and who interprets the responses of the PC chief, whereas in the second case, this transmission may be automatic.

BRIEF DESCRIPTION OF THE FIGURES

The invention will be better understood with the aid of the following description of the system of aiding the movement of work trains according to the invention and of the method that it uses, with reference to the appended drawings in which.

DETAILED DESCRIPTION OF THE INVENTION

Figure 1:
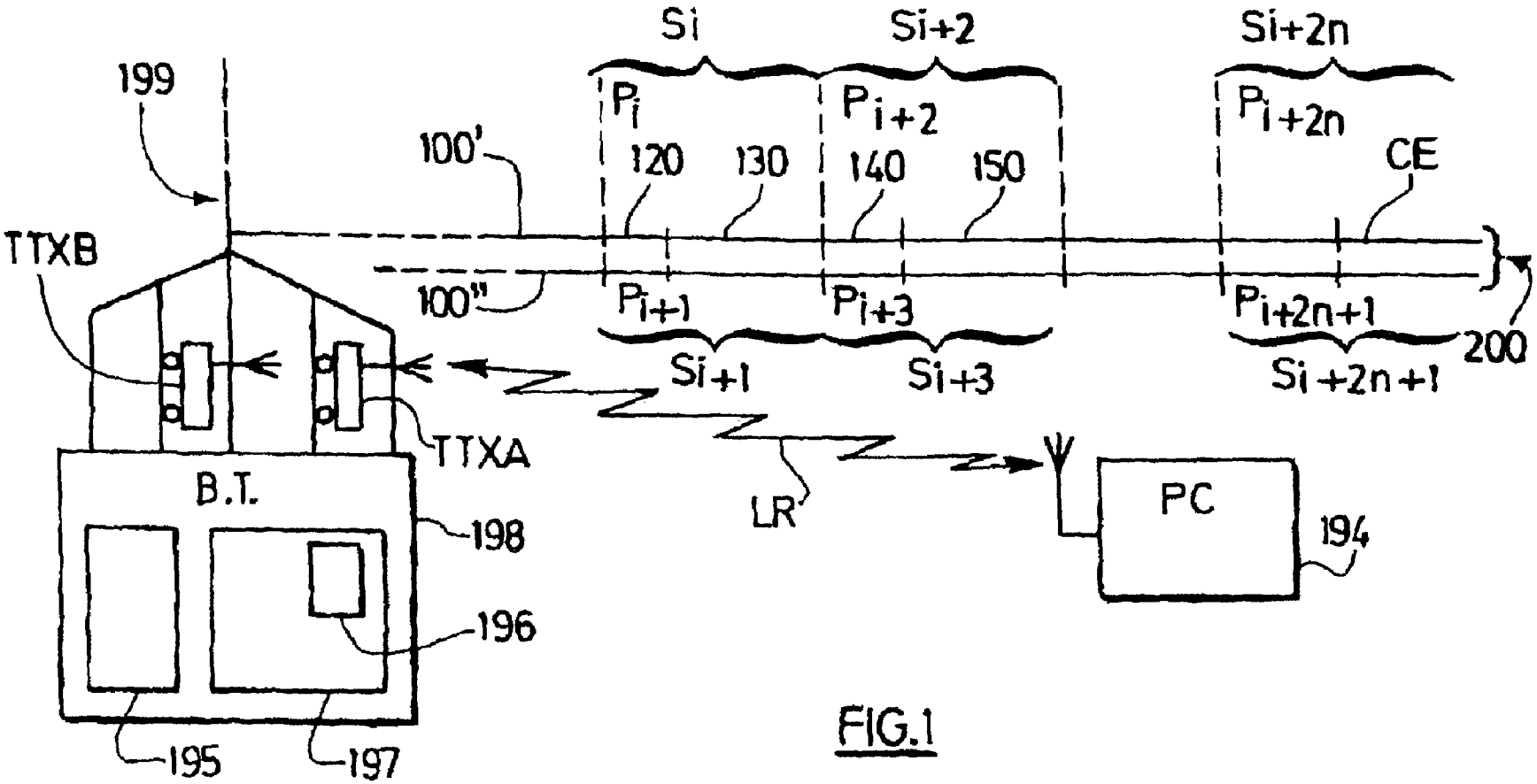
FIG. 1 illustrates the general principle of work train movement in section according to the method of the invention.

With reference to FIG. 1, the tracks 100' and 100" of the line 200 of a railway under construction connect at least one elementary work-site CE to its work base BT.

The work base BT is arranged so as to allow the constitution and distribution of work trains TTX A, B, etc on the line 200 with the elementary work-site CE as their destination.

Thus, a train leaving a set of formation sidings 196 of a marshalling zone 197 of a work base 198 travels via a track junction block 199 before moving on the line, an agent of the points-marshalling block 195, after agreement by the PC chief 194, controlling the predicted itinerary over the track junction block 199.

The lines are arranged as described below:

A line 200 is divided into successive adjacent sectors Si, $S_{i+2}$, etc. on the track 100' and $S_{i+1}$, $S_{i+3}$, etc. on the adjacent track 100". Blocks $P_i$, $P_{i+2}$, etc and $P_{i+1}$, $P_{i+3}$, etc. respectively delimit these sectors on these tracks.

The blocks $P_i$, $P_{i+2}$, etc. have a length of track 120, 140, etc. of 1500 metres at least, whereas the sectors $S_i$, $S_{i+2}$, etc. may have a length of track 130, 150, etc. much greater (approximately 10 km) so that they can run "in section", at a speed of 80 km/hour approximately. In comparison, the blocks are always travelled by running by sight except when they are used as parking track.

Figure 5:
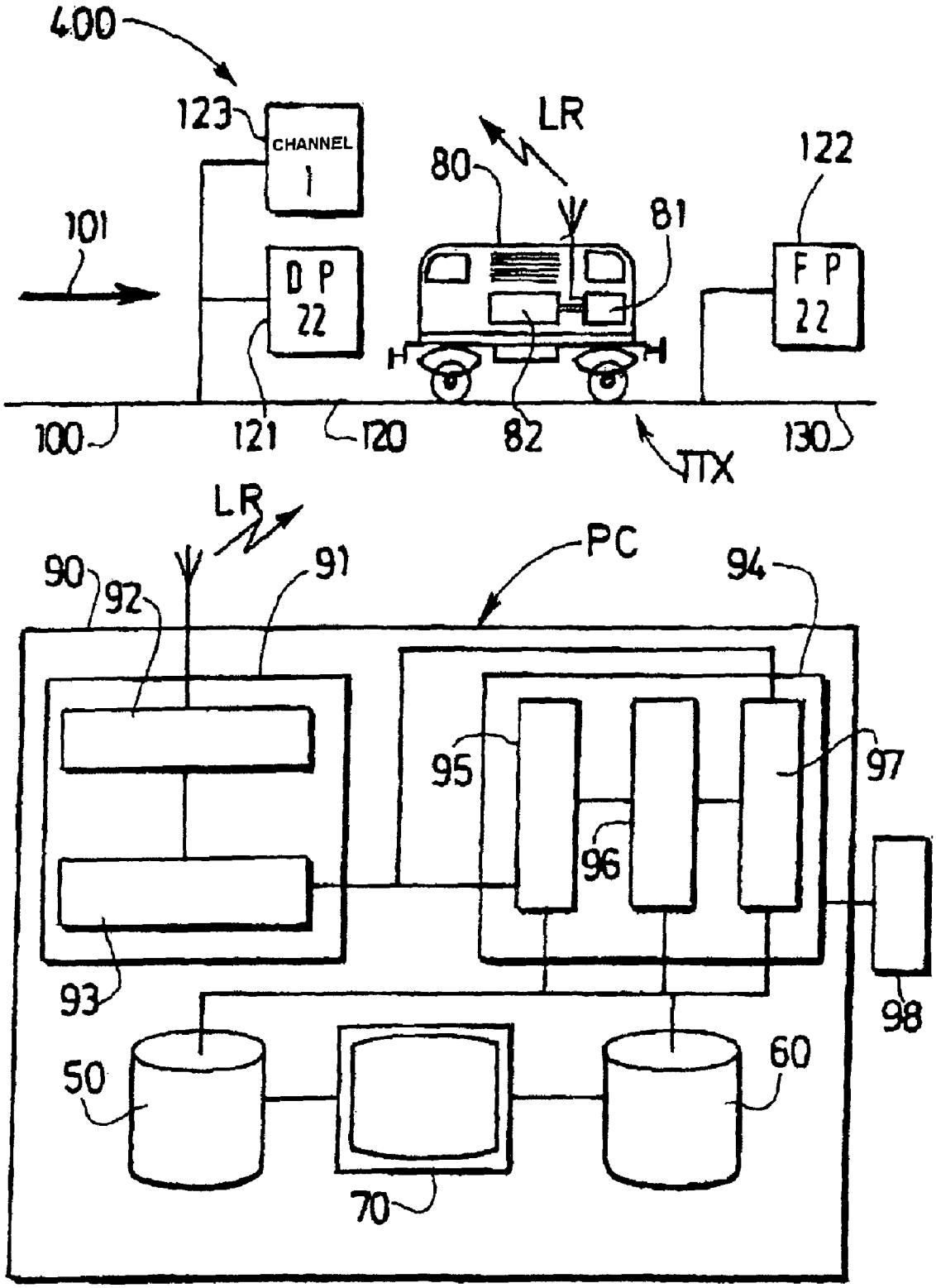
FIG. 5 is a functional block diagram of the system of aiding the movement according to the invention.

Based on this arrangement in sectors, the system 400 (FIG. 5) aiding the movement of work trains comprises primarily signalling elements disposed along the tracks allowing escort agents to locate the train TTX that they are escorting.

These signalling elements may be radio beacons with frequencies locked onto the special channels recognized by equipment on board the trains, but here, the preference is more simply for indicator panels as described below.

Furthermore, the system 400 of aiding movement comprises onboard electronic means available to the escort managers on the trains to help a PC chief situated in a central block PC to regulate and control the movement of the trains. These electronic means will be described later.

Figure 2:
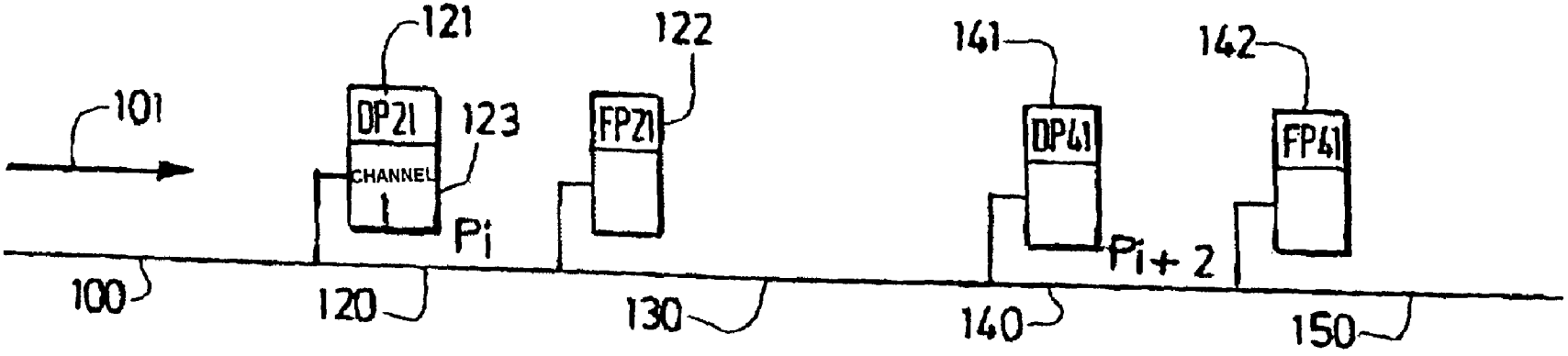
FIGS. 2, 3 and 4 show an example of signalling elements equipping the railway lines for the location of the trains on the sectors, comprising respectively one one-way track, one two-way track and two two-way tracks.

In relation to the signalling elements, with reference to FIG. 2, on a one-way track 100 travelled in a single direction 101, are placed indicator signboards 121, 141, etc. of the beginnings of blocks $P_i$, $P_{i+2}$, each bearing an inscription, for example DP 21 (beginning of block No. 21), etc. DP 41 (beginning of block No. 41) and indicator signboards 122, 142, etc. of the ends of blocks Pi, $P_{i+2}$, etc. each bearing an inscription FP 21, FP 41, etc. (end of block 21, 41, etc.). These inscriptions identify each block $P_i$ reached by the work train while locating the beginning and the end of the portion 120, 140 of the track on which it is possible to park. They are visible only from a train moving in the direction 101.

Figure 3:
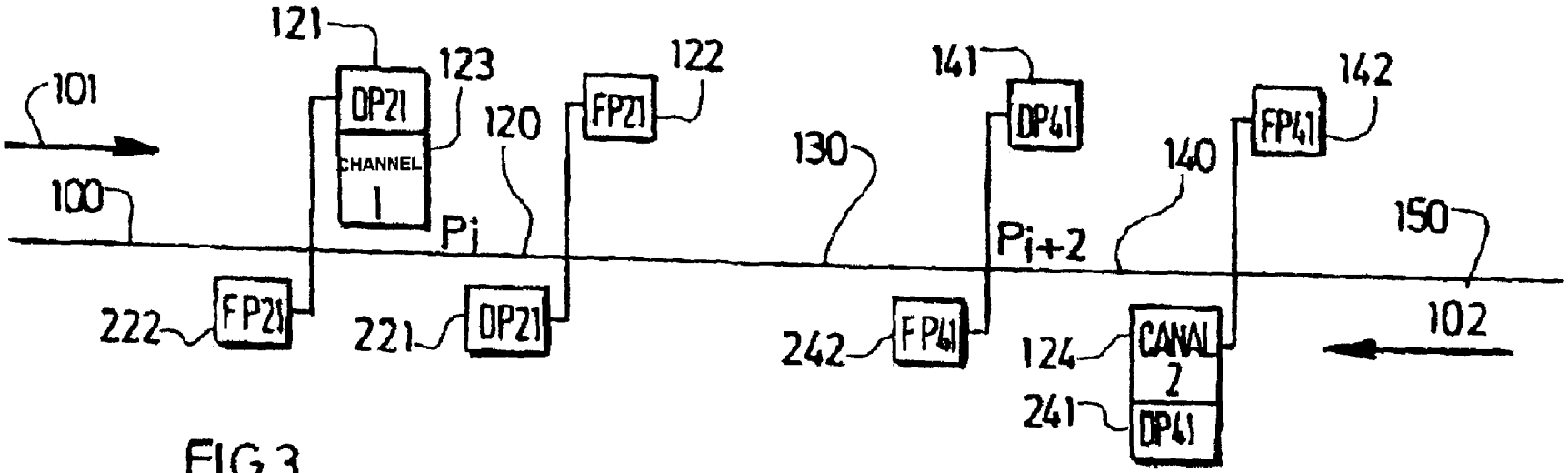

With reference to FIG. 3, on a two-way track 100 allowing two opposite directions of movement 101 and 102, the lengths of track 120, 140, etc. of the blocks $P_i$, $P_{i+2}$ have ends which are at the same time beginnings of blocks for one direction of movement and ends of blocks for the opposite direction of movement.

That is why, on these two-way tracks, additional signboards 221, 222, 241, 242, etc. have been placed on the backs of the signboards 122, 121, 142, 141, etc. which for their part are visible only from the trains moving in the direction 102.

To differentiate the directions of movement 101 and 102, additional signboards 123, 124 indicate on which radio channel LR the work train TTX must communicate with the central block PC, the channels being different on these two signboards.

The radio channels used, or the sequence of numbers of blocks and of sectors travelled, constitute data for detecting the direction of movement of the trains.

Figure 4:
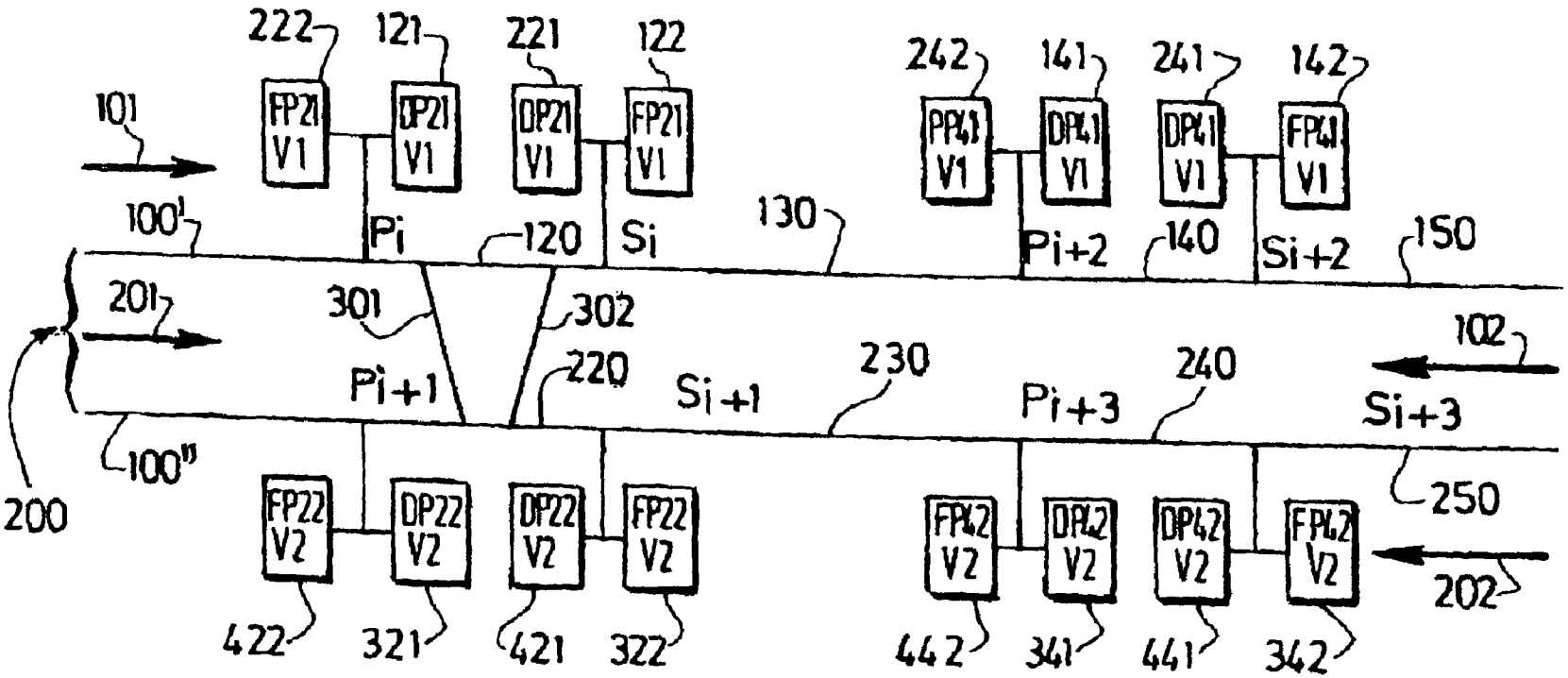

In the case of a line 200 comprising two adjacent two-way tracks 100' and 100", with reference to FIG. 4, the tracks are organized into blocks Pi and sectors Si on the track 100' and into adjacent blocks $P_{i+1}$ (220, 240) and sectors $S_{i+1}$(230, 250) on the adjacent track 100", and comprise indicator signboards disposed as previously (221, 222 etc.—122, 121 etc. and 421, 422 etc.—322, 321 etc.). Additional signboards indicate the track number V1 OR V2. Finally, points 301 and 302 are disposed to connect and allow two-way working of the two adjacent tracks, bypassing the elementary work-sites if necessary and providing for trains moving in opposite directions on one and the same track to cross.

These various signalling elements allow the escort agent to locate the train in the sectors and in the blocks, and to transmit data on the movement and/or location of the train that he is escorting to the PC chief. Each work train TTX 80 (FIG. 5) comprises a radio transceiver 81 and, coupled to the latter, a man-machine interface (MMI) 82, with a keyboard and screen not shown, and allowing the escort agent to send messages to a central block 90 and to receive messages, via the channel LR of a radio link therewith.

The central block 90 for its part comprises central means 91 of communication including a radio transceiver 92 and a modem 93 for converting the signals received in baseband assimilable by a computer 94 for regulating and controlling the movement of the trains.

The computer 94 comprises essentially means of managing and means of processing data in liaison with a block diagram panel 70, here a video display screen, means 50 of storing the messages and means 60 of storing data, in particular for controlling the display of the block diagram panel in display data characteristic of the lines, the sectors, the blocks and the location of the work trains and of the elementary work-sites.

The computer 94 comprises means 95 of managing the messages received on the modem 93, means 96 of processing the detection and location data contained in the messages received, and means 97 of managing the messages to be sent via the modem 93. It is also connected to input means 98, here a man-machine interface MMI comprising at least an alphanumeric keyboard and screen in particular for entering data for controlling the block diagram panel, including the display data, and storing them in the means 60, or for making requests to display messages stored in the means 50 in the form of a log.

The module 95 dates and stores the messages received in the means 50 and the module 97 for managing the messages to be sent generates dates and stores the messages sent in these same means 50. As for the module 96 for processing the detection and location data, it is arranged so as to interpret the messages received, verify the movement conditions, deduce the tenor of the messages to be sent, and where necessary update the block diagram panel.

The operation of the system 400 of aiding the movement of the work trains in section will now be described.

Figure 6:
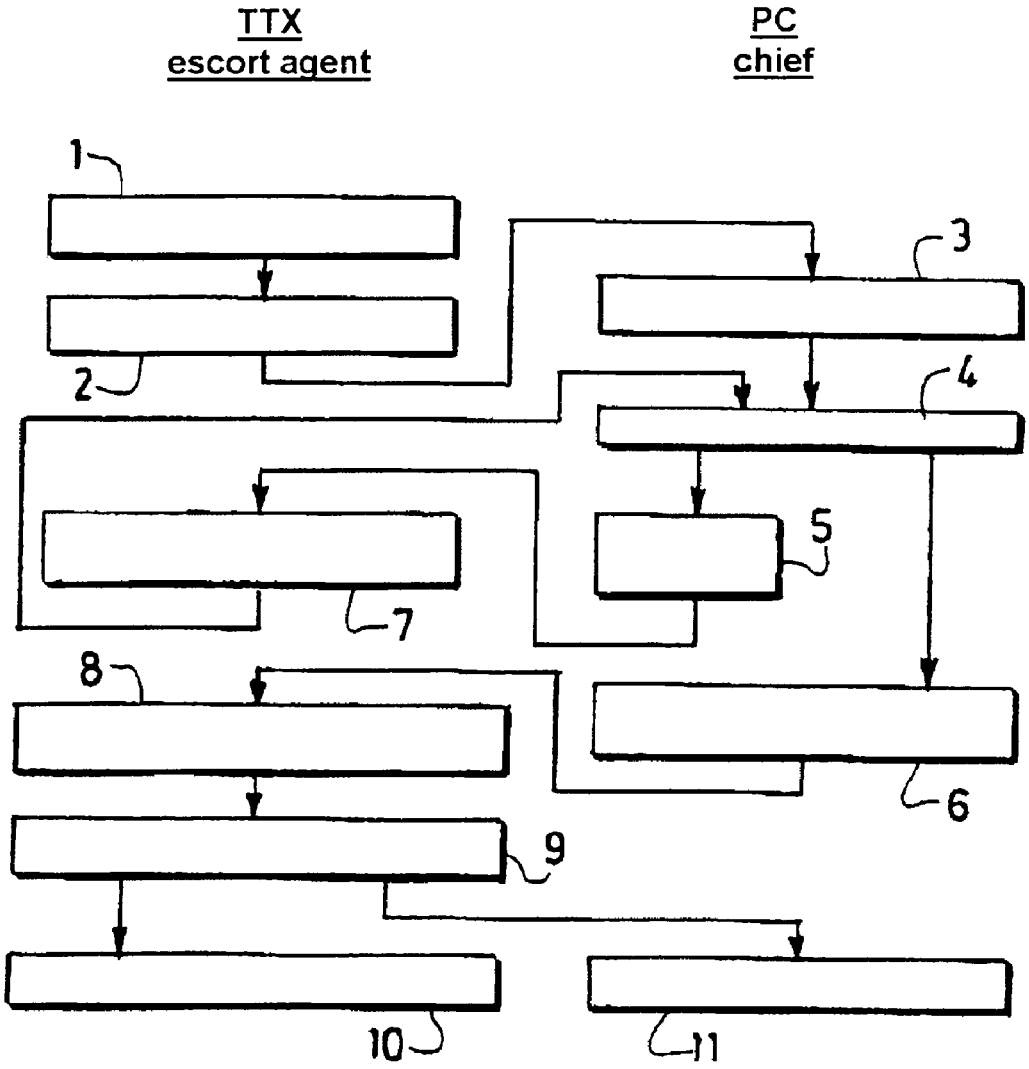
FIG. 6 is a flowchart illustrating a typical example of message interchange, conforming with the invention, between the work trains and the central block.

With reference to FIG. 6, when the escort agent of the work train 80 has obtained the authorization to leave his work base BT, delivered by the agent of the points-marshalling block, the train 80 may, during a step 1, move and access a block Pi of the track 100' of the line 200 by running by sight on the portion of track 120 of the block, from the beginning of the block indicated by the signboard 121, to the end of the block, indicated by the signboard 122.

The escort agent, that is to say the train 80, then, in step 2, asks the PC chief, that is to say the central block 90, for authorization to move on the length of track 130 of the sector Si by sending a radio message M1 on the channel LR using his transceiver 81. The channel LR used, previously indicated by a signboard 123 (or 124) is here specific to the direction of movement 101 (or 102).

For this, the escort agent enters on the MMI 82 the data comprising the message M1, that is to say at least the identification A of the train and the number P identifying the block Pi reached, indicated on the signboard 121 for the beginning of the block (DP21).

In step 3, this message M1 is received by the transceiver 92 of the PC 90, is digitized and decoded by the modem 93, then, during the subsequent step 4, after storage in the means 50 and display on the MMI 98 by the module 95, is analysed by the processing module 96. This analysis is carried out according to certain criteria, developed later, for deciding on the mode of movement over the length of the track 130 of the sector Si or on the stopping of the train on the length of track 120 of the block Pi.

If the result of the analysis is negative, in step 5, a wait message M2 is generated by the module 97 for managing the messages to be sent and, at the same time as being stored in the means 50, is sent by the transceiver 92 to the transceiver 81 of the train A, for example, via the same channel LR.

The receipt by the escort agent of the message M2 has the effect, in step 7, of causing the train to stop at the end of block signboard 122.

If the result of the analysis is positive, the module 97 for managing the messages to be sent, in step 6, generates a message M3 authorizing the train A to move in section on the length of track 130 of the sector Si. This message M3 is also stored in the means 50.

During step 8, this message is transmitted to the train 1 by the transceiver 92. Subsequently, the escort agent, in step 9, sends an acknowledgement message M4 to the PC chief and, in step 10, the train A moves in section on the sector Si.

In step 11, the acknowledgement message M4 is managed by the management module 95 and the processing module 96 updates the block diagram panel 70 while storing, in the means 60, the occupancy of the sector Si by the train A.

The method of controlling the movement described above is identically reiterated every time that the train TTX accesses a new block Pi until it arrives at the elementary work-site CE.

The log, stored as has been seen in the memory 50, may be viewed at any time on the screen and used for example at the request of the PC chief thanks to the MMI 98, in correlation with the block diagram panel 70 which provides him with any aid he requires.

Figure 7:
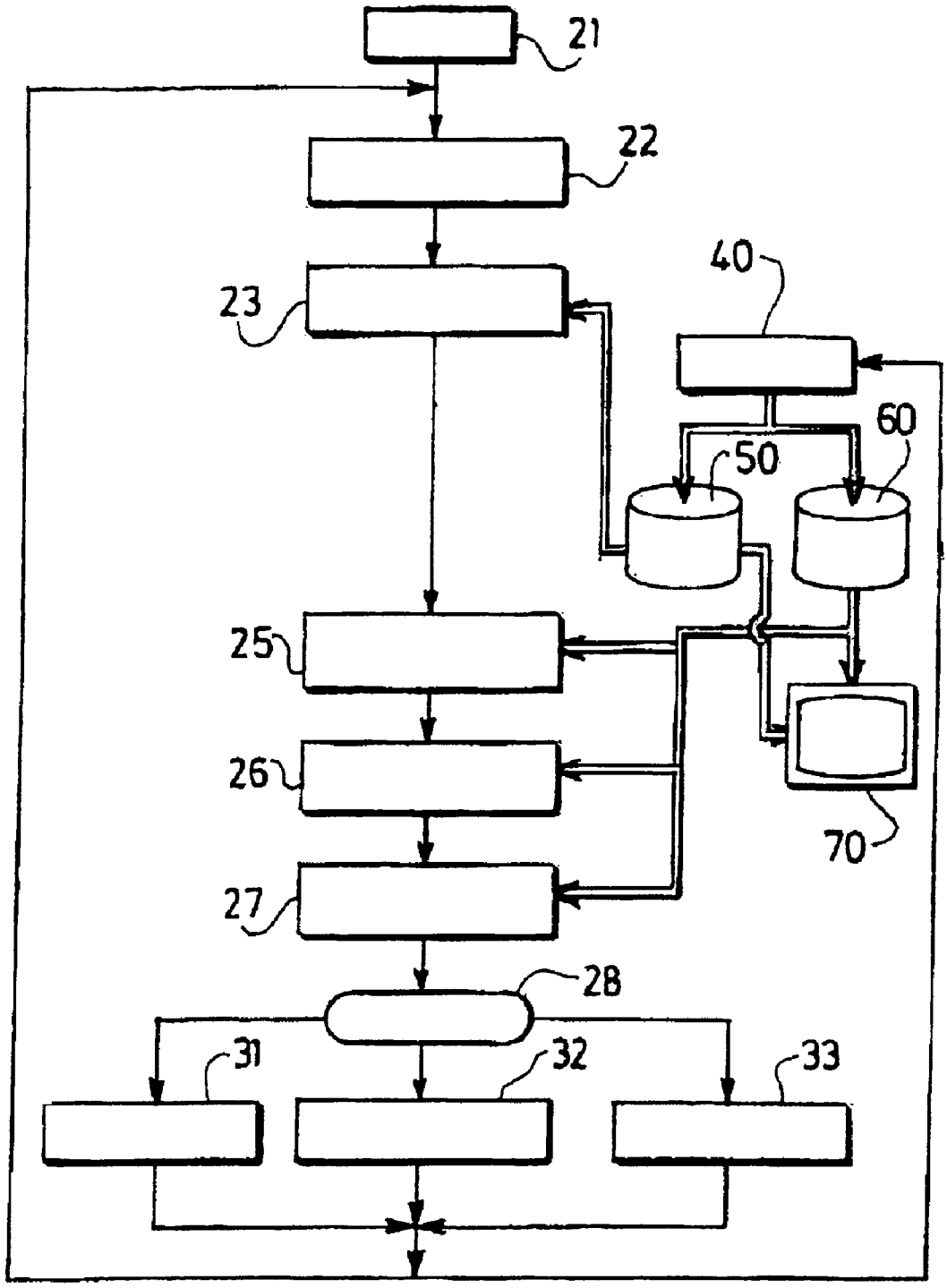
FIG. 7 is a flowchart of the operation of the aid system according to the method of the invention and FIG. 8 shows an example of the display of a block diagram panel of lines under construction and of the control of movement according to the method of the invention.

More precisely, with reference to FIG. 7, on receipt of a message Mi originating from the train 80 via the receiver 92 of the central block PC 90, in a step 21, the transceiver 92 transmits the message Mi to the modem 93 converting the analogue message received into a digital message that can be understood by the computer 94 in a manner known to those skilled in the art. During step 22, the module 95 for managing the messages received extracts from it the number P of the block Pi reached, the identification A of the train 80, the nature of the request, for example a request to move on the sector Si following the block Pi in the direction of travel of the train indicated by the channel LR, and supplements these detection and location data A, P, LR, during a subsequent step 23, with any additional data available in the memory 50 and entered by the PC chief using the MMI. These additional data may for example specify the composition of the train A, the specifics of the block Pi, the various radio channels used depending on the tracks and the direction of movement, the urgency of the routing of the train A, etc.

The detection and location data are transmitted to the processing module 96 which, during subsequent steps, searches in succession in the memory 60 for:

- during step 25, the train TTX immediately preceding the train A on the track 100', running in the same direction 101 and the sector Sj or the block Pj it has reached,
- during step 26, the closest train TTX coming towards the train A on the track 100' (if this track is two-way) and the sector Sk or the block Pk it has reached,
- during step 27, whether the line comprises two tracks, the location S1 of the elementary work-site CE closest to the sector Si and situated on the track 100" adjacent to the track 100' used by the train A.

Each of the steps 25, 26, 27 then computes the numbers N1, N2, N3 of sectors free of trains between the sector Si and the sectors Sj and Sk, or the location S2. These numbers N1, N2, N3 are compared with minima n1, n2, n3 that must not be exceeded, during a step 28, in order to decide according to whether the minimum concerned has or has not been exceeded, that:

- the train TTX A may move in section on the sector Si, in which case, during a step 31, a message M is sent in response to the message M1 with a "movement in section on the sector Si" mention, the train TTX A may move on the sector Si by running by sight, in which case the message M3 sent during a step 32 comprises a "movement in work mode on the sector Si" mention, the train TTX A must, at the end-of-block panel of the block Pi, await a subsequent authorization to move on the sector Si, in which case, during a step 33, a message M2 is sent thereto.

At the end of the process, in a step 40, the management module 95 updates the log in the storage means 50 and the block diagram panel 70 in the storage means 60.

The minima n1, n2, n3 not to be exceeded depend on the safety conditions established in advance.

In normal use of the system, the following conditions may be adopted:

$$\begin{cases} N1 = |j - i|/2 \\ n1 = 1 \text{ and } N1 \geq n1 \end{cases}$$

In this case, a train B may not enter a sector Si already occupied by a train A running in the same direction:

$$\begin{cases} N2 = |k - i|/2 \\ n2 = 2,\ N2 \geq n2 \end{cases}$$

In this case, a train B running in one direction may not enter a sector Si if a train A running in the opposite direction on the same track is occupying the sector $S_{i+2}$:

$$\begin{cases} N3 = |1 - i - 1|/2 \\ n3 = 1 \text{ and } N3 \geq n3 \end{cases}$$

In this case, movement in work mode on the sector Si is imposed only if the adjacent sector $S_{i+1}$ is in elementary work-site condition CE, otherwise the train may move in section.

Figure 8:
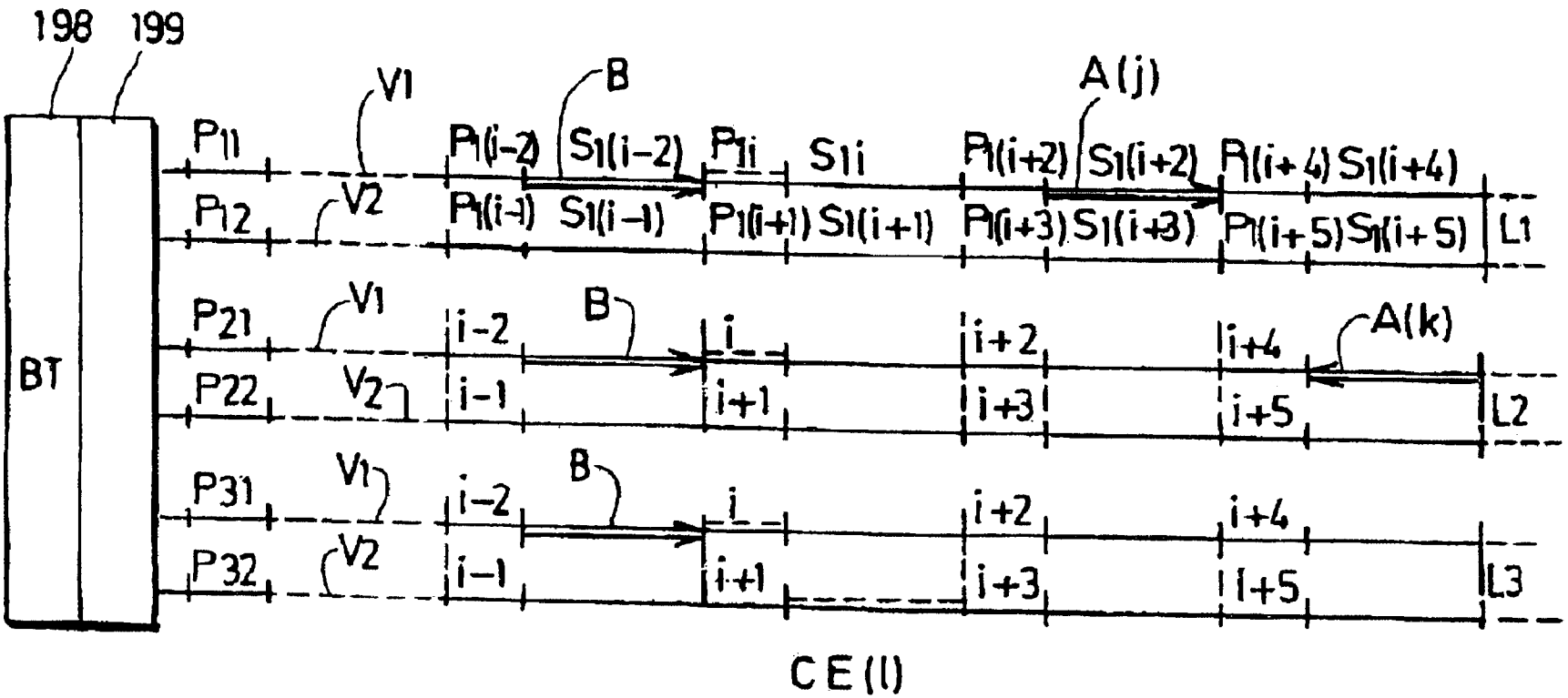

In accordance with the above safety levels, the block diagram panel displayed on the screen 70 may have the aspect shown in FIG. 8. In this figure, three lines under construction, L1, L2, L3, have been represented, each one comprising two tracks V1 and V2, and on each track, the sectors Si, extending between the end or beginning blocks Pi depending on the direction of movement, i−2, i, i+2, etc., and the adjacent sectors $S_{i+1}$ between the blocks $P_{i+1}$.

Each line L1, L2, L3 illustrates one of the three preceding cases of control exerted by the aid system 400, that is to say:

On the line L1, track V1, a work train B is occupying the sector S1(i−2) or the block P1i, occupation displayed on the panel 70, and requests to move in section on the sector S1i. The aid system 400 ascertains that it is preceded by a work train A occupying the sector S1j also displayed, j here being equal to i+2. If j−i is equal to or greater than n1, authorization may be given, since no train is moving in the sector Si.

On the line L2, the situation of the train B is the same, but the train A is occupying the sector S1k or the block P1k, k being equal to i+4. If k−1 is equal to or greater than n2, authorization may again be given, since no train is moving on the blocks or sectors Pi and Pi+2, Si and Si+2.

On the line L3, the sector S31, where l=i+1, of the adjacent track V2 being in elementary work-site condition CE, 1−i−1 being zero, only an authorization to move in work on the sector S3i may be given.

Authorization is then given only if these three verifications are made and the safety conditions respected.

The invention claimed is:

1. A method of aiding the movement of work trains on a railway line under construction having two tracks that are adjacent and two-way, and that is managed from a central block PC by a PC chief, comprising the following steps:

a) dividing the tracks into sectors, extending between two end blocks, on which the trains can move in section or in work mode; and b) at a request for authorization from an escort agent of a train to the PC chief to move in section in one direction on a given sector, i) making a check as to whether another train is moving on the sector in question, ii) making a check as to whether another train is moving on the following sector in the opposite direction, iii) making a check as to whether the adjacent sector of the adjacent track is undergoing work and, if the three checks are negative, iv) giving authorization by the PC chief to the escort agent to move his train in section.

2. The method according to claim 1, further comprising the process step of:

checking, for each block delimiting a sector, whether a train is moving in the opposite direction on the block terminating the sector in question in order to authorize the movement in section on the sector in question.

3. The method according to claim 1, further comprising the method step of:

controlling, after agreement by the PC chief, a predicted itinerary of a train over a track junction block with an agent of a points-marshalling block, wherein the train leaving a set of formation sidings of a marshalling zone of a work base travels via the track junction block before moving on the line.

4. The method according to claim 3, further comprising the method step of:

authorizing the train to leave the set of formation sidings to move on the line after the agent of the points-marshalling block actuates points of the track junction block.

5. The method according to claim 1, further comprising the method step of:

signaling the work train that it has reached a beginning or an end of a block and when the train reaches the beginning of a block, the train moves until it is completely on the length of the block; and requesting, by the escort agent to the PC chief, to move in section on the following sector, and when the train reaches the end of a block, the train complies with either an injunction to wait or with an authorization to move on the sector.

6. A system of aiding the movement of work trains on a railway line under construction having two tracks that are adjacent and two-way, wherein the tracks are divided into sectors, each of which extends between two end blocks, and on which the trains can move in section or in work mode, and wherein the railway line under construction is managed from a central block PC by a PC chief, said system comprising:

a) a computer at a central block for managing and processing data, comprising a block diagram panel for operating the line under construction, wherein the block diagram panel has at least the line's tracks, sectors and end blocks;

b) means for communication between the PC chief and escort agents of the work trains for authorization requests, from an escort agent of a train to the PC chief to move in section in one direction on a given sector;

c) means for storing messages;

d) means for locating a train on the sectors of the line, wherein said means are connected to the computer;

e) means for detecting the direction of travel of a train on the sectors of the line, wherein said means are connected to the computer;

f) means for entering the state of work of the sectors, wherein said means are connected to the computer; and g) means for processing the data from the means for detecting and the means for locating so that, if i) no other train is moving on a sector in question, ii) no other train is moving on the following sector in the opposite direction, and iii) the adjacent sector of the sector of the adjacent track is not in works mode, the PC chief authorizes the escort agent of a train to move in sections on the sector in question from one end block of the sector to the other end block of the sector.

7. The system according to claim 6, wherein a sector is represented on the block diagram of the central block PC as totally occupied when a work train is moving on it.

8. The system according to claim 6, wherein the means for locating trains on the sectors comprises signalling elements at the beginnings and ends of the end blocks that delimit the sectors at their ends, wherein said signalling elements identify the blocks and the sectors; and wherein the means for communication between the train and the central block arranged so as to exchange messages, wherein said messages include requests for authorization to move in section, injunctions to wait, and authorizations to move in section.

9. The system according to claim 8, in which the signalling elements comprise indicator signboards.

10. The system according to claim 8, in which the signalling elements comprise radio beacons.

11. The system according to claim 6, wherein the signalling elements supply the number of the block.

12. The system according to claim 6, wherein the signalling elements supply the number of a channel.

13. The system according to claim 12, wherein the channel is specific to the direction of movement.

14. The system according to claim 6, wherein the authorization requests comprise identifying the train.

15. The system according to claim 6, wherein the means for processing are arranged so as to deduce, from the state of occupation of the sectors stored in the storage means, and from a movement request message from a train, the conditions of movement of that train in order to decide whether the train may or may not move in section.

* * * * *